United States Patent [19]

Görike

[11] 4,158,753

[45] Jun. 19, 1979

[54] HEADPHONE OF CIRCUMAURAL DESIGN

[75] Inventor: Rudolf Görike, Vienna, Austria

[73] Assignee: AKG Akustische u.Kino-Gerate Gesellschaft m.b.H., Austria

[21] Appl. No.: 873,391

[22] Filed: Jan. 30, 1978

[30] Foreign Application Priority Data

Feb. 2, 1977 [AT] Austria ..... 669/77

[51] Int. Cl.[2] ..... H04R 1/22

[52] U.S. Cl. ..... 179/182 R

[58] Field of Search ..... 179/182 R

[56] References Cited

U.S. PATENT DOCUMENTS 4,071,717 1/1978 Fidi et al. ..... 179/182 R

*Primary Examiner*—William C. Cooper

*Attorney, Agent, or Firm*—McGlew and Tuttle

[57] ABSTRACT

The headphone includes a cup-shaped case forming the coupling space and this cup-shaped case, in use, engages the user's head and encloses the user's ear. At least one electroacoustic transducer is included in the cup-shaped case, and the case either is designed as an acoustic frictional resistance or as a supporting structure of such a resistance. The headphone is equipped with acoustic and/or electrical systems compensating the drop at the low frequencies, and there are no reflecting surfaces located close to the external ear of the user. The low frequencies drop may be compensated by passive or blind diaphragms, or the diaphragm of the electroacoustic transducer may be coupled to an air mass. A headset, including two headphones, may be designed for quadraphonic reproduction.

8 Claims, 16 Drawing Figures

HEADPHONE OF CIRCUMAURAL DESIGN

FIELD AND BACKGROUND OF THE INVENTION

This invention relates to a headphone of circumaural design in which, in use, the rim of a cup-shaped case, forming the coupling space, is engaged with the user's head and encloses the user's ear and, more particularly, to an improved headphone of circumaural design in which there are no reflecting surfaces.

At the present time, such circumaural headphones are in wide use since they provide physical comfort even for long periods of time and give the designer enough space for accommodating acoustic and/or electrical systems intended for improving the reproduction properties of the headphone.

Headphones of the prior art, however, have the disadvantage that up to date, they were unable to solve the problem of the "in-the-head-localization" of the acoustic event.

The present invention is directed to an improvement of both the directional and the distance hearing and, in addition, to the elimination of the disturbing phenomenon of the "in-the-head-localization." The inventive headphone is also suitable for audiometric purposes.

Known headphone constructions having the same objective, such as the designs of German Offenlegungsschrift Nos. 2,540,680 and 2,343,818, do improve the spatial hearing to some extent. However, they fail in reproducing the acoustic event sufficiently far to the outside or ahead in accordance with the real event so that, in general, and as before, the impression is produced, for example, during the reproduction of a piece of music, that the listener would be seated in the midst of the orchestra.

Close examinations and measurements at the auricle have shown that the external ear has the greatest bearing on the directional and distance perception. It has been further found that a sound reflecting surface, even of a very small area, for example, of 2 $cm^2$ immediately adjacent the external ear, or of 1 $cm^2$ close to the auditory canal, already causes linear distortions of the audio signals which unfavorably affect the directional and distance hearing.

Even if, in general, sound reflections can rightly be compared to optical reflections, it is important to be aware of the fact that, with sound reflections, the reflecting surface is perceived as the location where the sound wave is produced.

SUMMARY OF THE INVENTION

The invention starts from the experience that no reflecting surfaces, primarily acoustically stiff surfaces, even of small extent, must be located close to the external ear if disturbances of the audio signals are to be avoided. Particularly disturbing, are surfaces around the electroacoustic transducer or the ear pad, even if the latter is only about 1 cm high or thick and encloses the ear. To obtain non-distorted signals in the ear, the acoustic properties of the auricle must remain undisturbed in their effect.

In consequence, the invention is directed to a headphone of the kind indicated above in which reflecting surfaces are absent. This is obtained, in accordance with the invention, by providing that the whole of the cup-shaped case, accommodating at least one electroacoustic transducer, either is designed as an acoustic frictional resistance or is designed as a supporting structure of such a resistance, and by further providing the possibility of equipping the headphone with acoustic and/or electrical systems compensating the drop at the low frequencies.

There may be a need for emphasizing the low frequencies in the headphone embodying the invention because, through the frictional resistance formed by the case, a connection is established to the outside air or to the backside of the transducer diaphragm, which, in the absence of particular measures, leads to a characteristic with dropping low frequencies.

As acoustic measures for compensating the drop, there may advantageously be provided passive or blind diaphragms which are disposed close in front of the wall of the cup-shaped case designed as a frictional resistance.

Another possibility is to couple the diaphragm of the electroacoustic transducer to an air mass, in order to shift the natural resonance of the diaphragm toward the range of low frequencies.

The frequency response, however, also may be compensated electrically, for example, by putting a low-pass filter into the circuit. It may be useful to provide simultaneously two or three of the mentioned measures for compensating the frequency response.

For the effect intended by the invention, the location where the electroacoustic transducer or transducers are disposed in the cup-shaped case is of fundamental importance, since, after all, the user's external ear has to perform its function in the same way as during natural hearing. If the headphone embodying the invention is designed as a stereo headset, the transducer of each earpiece can be located in a manner such that, with the headset in use, the sound comes to the user from in front. This is done by providing the electroacoustic transducer of each earpiece laterally in front, close to the rim of the cup-shaped case.

If the headset of the invention is designed for quadraphonic reproduction, analogously, a second transducer is provided in each earpiece, which, in use of the set, is located laterally at the back, also close to the rim of the cup-shaped case.

To improve the sealing between the user's head and the cup-shaped case designed as a frictional resistance, as well as to make the use more comfortable, the rim of the case is provided, in accordance with the invention, with a circumferential pad. Such pads are well known. Ordinarily, their height or width is of 1 to 2 cm. In the headphone of the invention, pads of such height are not suitable, since their surface still represents a considerable reflection factor and, with the conventional dimensions and in view of the findings underlying the invention, entails a disturbing influence. For this reason, in the headphone of the invention, a pad is provided having a height or width, preferably, of 2 to 3 mm. A pad filled with a liquid has proven advantageous.

Due to the inventive measures described in the foregoing, any reflection of the sound, particularly in the high frequency range, is suppressed and the intended effect of the directional and distance hearing is obtained.

An object of the invention is to provide an improved headphone of circumaural design.

Another object of the invention is to provide such a circumaural headphone having improved directional and distance hearing characteristics.

A further object of the invention is to provide such a circumaural headphone in which the disturbing phenomenon of the "in-the-head-localization" is eliminated.

Yet another object of the invention is to provide such a circumaural headphone which is suitable for audiometric purposes.

For an understanding of the principles of the invention, reference is made to the following description of typical embodiments thereof as illustrated in the accompanying drawings.

DESCRIPTION OF THE PREFERRED EMBODIMENTS

Figure 1:
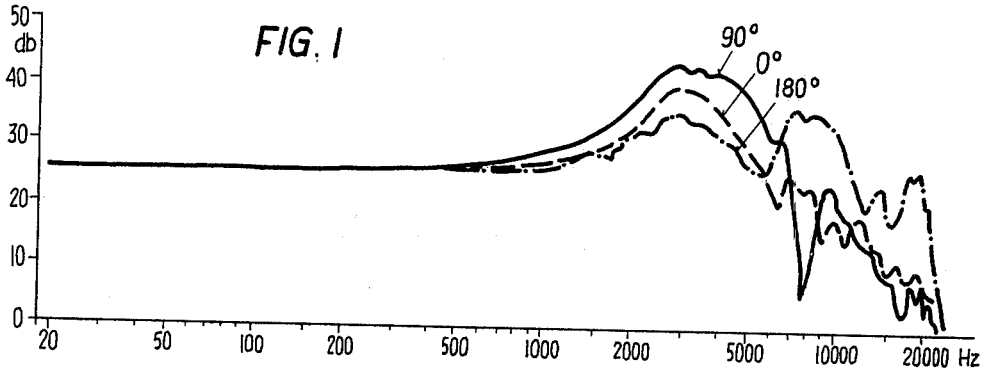
FIG. 1, to explain the inventive idea, is an audiogram showing the monaural free-field response of the human ear, for 0°, 90° and 180°.
Figure 2:
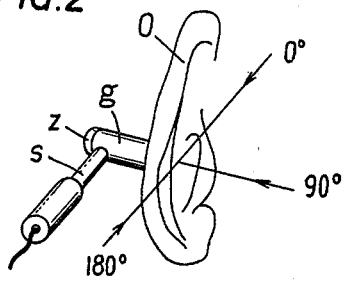
FIG. 2 is an axonometric view of the respective arrangement for measuring this response.

The curves shown in FIG. 1 for illustrating the invention are results of measurements with a device shown in FIG. 2 as comprising an artificial auricle 0 made of a soft plastic corresponding to the mechanical structure of the human ear, and followed by an auditory canal g closed by an acoustic impedance Z having a value corresponding to that of the eardrum. The measurements have been carried out in a plane sound field, for angles of incidence 0°, from in front, 90° from the side, and 180° from behind, relative to the human head, and the transmission has been controlled over the whole audible range by means of a microphone probe S connected laterally to the end of the auditory canal g.

Since the artificial auricle has been placed in the free, plane, sound field alone, without a user's head, the results of the measurement relate solely to the acoustic effect of the auricle and the auditory canal.

If, as usual, the stereophonic recording is made with two microphones, the maximum response directions of which form an angle of about 120°, the shading by the head occurring during natural listening and the directional response of the individual microphones are imitated. With a loudspeaker reproduction, the ear resonances are added only during the aural reception.

In most headphones, even electrostatic ones, no attention is paid to the fact that, in order to obtain a stereophonic acoustic phenomenon, the ear resonances must become effective. If the electroacoustic transducer radiates into the ear axis, thus in the direction of the auditory canal, the characteristic ear resonances which are effective during a frontal reception of the sound cannot be produced.

The difference may be noted from FIG. 1. In order to displace the acoustic phenomenon caused by the headphone as far as possible in the forward direction where the sound sources are predominantly located, the electroacoustic transducer is mounted, in accordance with the invention, preferably in the front side wall of the coupling case and the direction of radiation is chosen so as to coincide with the 0° sound incidence during natural hearing. For the quadrophony, two transducers mounted in the opposite side walls of the coupling case are used. The lateral mounting of transducers is known per se. However, it has not been taken into account that already small sound reflecting surfaces immediately adjacent the ear, or the side walls or the ear pad, may render the lateral sound incidence completely ineffective. An acoustic resistance, for example, a non-woven fabric, stretched on a bar grate, is capable of reflecting only a very small part of the sound waves. This small percentage is not disturbing in practice, because, due to the masking effect, this small amount does not become acoustically effective.

The acoustic frictional resistance, which is effective over large surfaces, comprises preferably a porous material having a small thickness. Suitable such materials are, for example, non-woven fabric, sintered material, or etched or electroplated, perforated sheet metal. As a supporting structure, mechanical constructions of any kind may be used which are permeable to sound to such an extent that their acoustic reflective power is negligible even at the highest frequencies.

Figure 3:
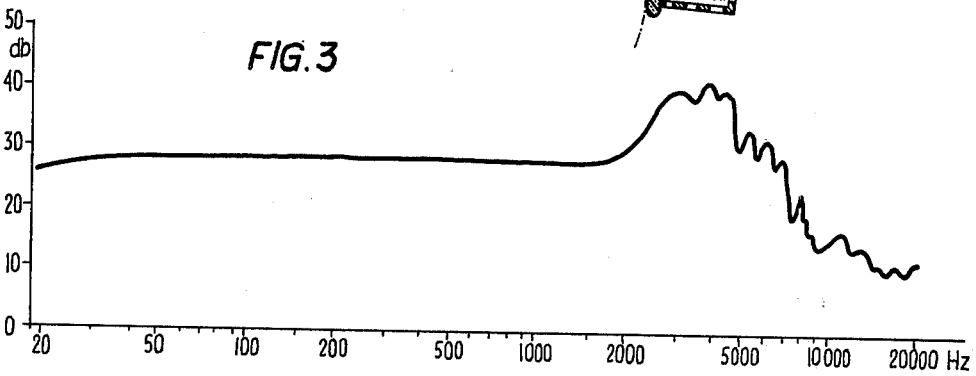
FIG. 3 is an audiogram showing the frequency response of a headphone embodying the invention.

FIG. 3 shows the transmission characteristic of a headphone of the invention. There is a similarity with the curve for 0° sound incidence of FIG. 1. It is to be taken into account that any deviation from the natural aural signal appears as a disturbance of the stereo hearing, irrespective of whether the deviation has its origin in the electroacoustic transducer or in other parts of the headphone.

Since the "in-the-head-localization" is caused by a coherence of the aural signals arriving into the two ears, this disturbing phenomenon occurs in cases where, due to linear or non-linear distortions in the headphone, identical auditory events are produced for both ears. As headphones are designed symmetrically, identical distortions are caused, for example, by the acoustic transducers, or by resonances and reflections in the coupling spaces. These distortions prevail over the aural signals which are determining for the directional and distance hearing and differ only slightly from each other, so that, even if no "in-the-head-localization" occurs, at least the stereo hearing is disturbed. Any sound quality typical of a particular headphone is a linear distortion occurring as an envelope of the useful signal and, due to the symmetry, capable of causing the "in-the-head-localization."

The invention is effective, to the same extent, for conversions based on any principle, for example, for electrodynamic, electrostatic, as well as piezoelectric or orthodynamic systems.

To comply with the inventive concept of eliminating the resonance effect of an ear pad, instead of a voluminous pad usual in conventional circumaural headphones, only a flat, soft sealing strip of a textile material, rubber, or plastic is used which, in addition, is more comfortable. Liquid-filled, very flat pads (having a height or width, for example, of about 2–3 mm) are very effective.

Figure 11:
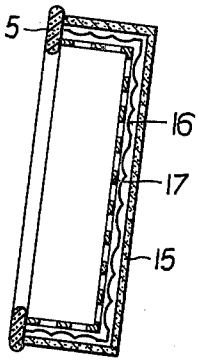
FIG. 11 is a sectional view of a design in which a sintered material provides the acoustic frictional resistance and a diaphragm is arranged in closely spaced relationship therewith.
Figure 12:
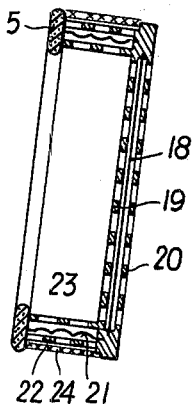
FIG. 12 is a sectional view of an electrostatic headphone, in accordance with the invention, comprising a large-surface diaphragm and side portions of the case, which are as a whole provided with an acoustic frictional resistance and with diaphragms extending in front thereof.
Figure 13:
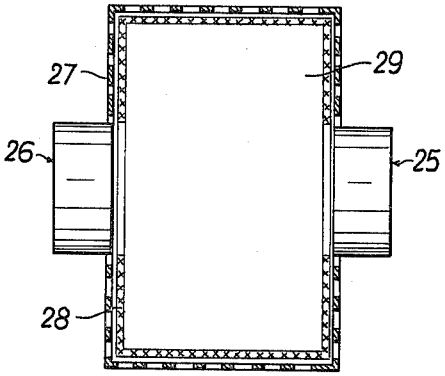
FIGS. 13 and 14 are sectional views showing embodiments intended for quadrophonic transmission.
Figure 14:
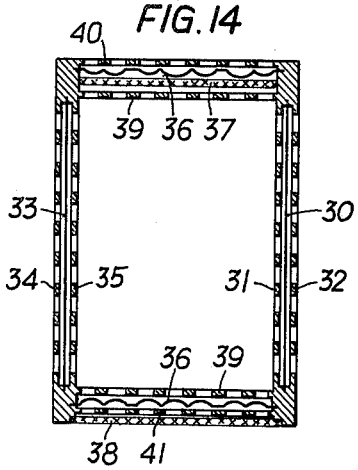

FIGS. 4 to 12 show stereo headphones, and FIGS. 13 and 14 show headphones for quadrophonic hearing.

In the figures referred to in the following, embodiments of headset earpieces are shown. It is understood that a headset comprises two earpieces which are connected to each other by a resilient headband.

Figure 4:
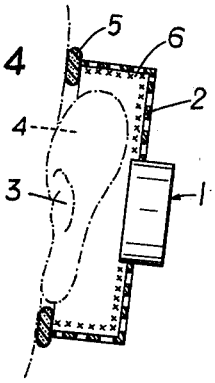
FIG. 4 is a sectional view of a headphone embodying the invention having the transducer mounted centrally.

According to FIG. 4, the transducer 1 is built in in a case 2 having a lattice structure of plastic or metal, in a manner such that it radiates in the direction of auditory canal 3. The external ear 4 projects into the cavity of case 2. A flat elastic ring 5 makes the earpiece substantially snugly fit the user's head and provides wearing ease. The acoustic frictional resistance 6 extends over the entire surface of case 2, advantageously at the inside thereof. The case may also be of rectangular shape and surround the external ear very closely.

Figure 5:
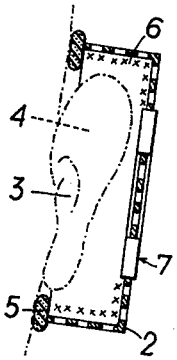
FIG. 5 is a sectional view of a headphone with an annular transducer.
Figure 6:
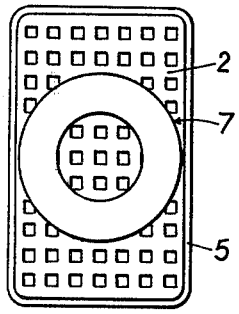
FIG. 6 is an elevation view corresponding to FIG. 5.

In the design of FIG. 5, an annular transducer 7 is provided operating, for example, on the electrostatic or orthodynamic principle. The acoustic frictional resistance 6 is also provided in front of the auditory canal, which has a favorable effect. FIG. 6 is an elevation view corresponding to FIG. 5.

Figure 7:
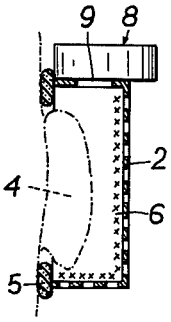
FIG. 7 is a horizontal sectional view of an embodiment with the transducer mounted on the side wall of the cup-shaped case.
Figure 8:
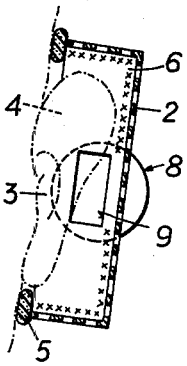
FIG. 8 is a longitudinal sectional view corresponding to FIG. 7, although the transducer might also be mounted obliquely.

FIG. 7 is a horizontal sectional view of a headphone. The dynamic transducer 8 has its sound aperture 9 applied to the side wall of case 2. FIG. 8 is a longitudinal sectional view of the arrangement of FIG. 7.

Figure 9:
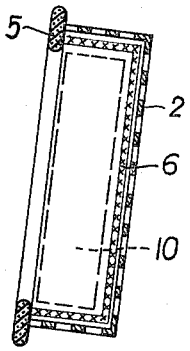
FIG. 9 is a sectional view showing a headphone in which the transducer fills the entire side wall and works on the orthodynamic, electrostatic, or piezoelectric-diaphragm principle.

In the design of FIG. 9, an electrostatically or orthodynamically operating transducer 10 fills the entire front side wall of case 2.

Figure 10:
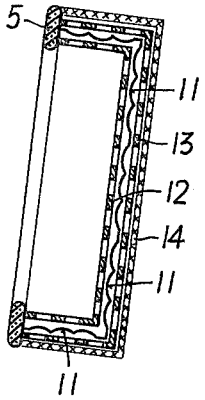
FIG. 10 is a sectional view of a design in which, aside from the acoustic frictional resistance of the case shell, a diaphragm arrangement is provided extending over the entire surface of the coupling space.

In FIG. 10, diaphragms 11 are provided in front of acoustic frictional resistance 14 which is applied to a grate structure 13. A grill 12 is mounted in front of the diaphragms, for mechanical protection. The sound may be introduced, for example, through the front side wall.

According to FIG. 11, a case 15 of sintered material, metal, or plastic is provided, which, as a whole, is provided with a diaphragm arrangement 16. The grill 17 serves for the mechanical protection of the diaphragm. In this design again, the front side wall may form the sound radiator.

FIG. 12 shows a large-surface electrostatic transducer comprising a diaphragm 18 and perforated electrodes 19, 20 which are provided spaced apart from opposite sides of diaphragm 18. Since diaphragm 18 has a very small mass, it is particularly suitable for high-quality sound transmissions. The side walls comprise diaphragms 21, a case formed by a grate structure 22, an acoustic frictional resistance 24, and a protective grill 23.

FIGS. 13 and 14 show embodiments of headphones for quadrophonic reception. In FIG. 13, the transducers 25 and 26 are incorporated in the side walls of case 27. The entire surface of the case, which is formed by a grate structure, is provided with an acoustic frictional resistance 28. Even the large surface 29 is entirely made up of acoustic frictional resistances. The showing is a front view into the cavity of the case. A diaphragm arrangement may be provided in front of the acoustic frictional resistance.

In the design of FIG. 14, two electrostatic transducers with respective diaphragms 30, 33 between respective electrodes 31, 32, or 34, 35, are provided and they completely fill the side walls. By way of example, in the upper side wall, case portion 40 is provided with a diaphragm arrangement 36 and an acoustic frictional resistance 37 on a grating 39. In the lower side wall, the sequence is different. Behind grating 39, the diaphragm arrangement 36 is secured to a grate 41 on which the acoustic frictional resistance 38 is also supported.

The diaphragm arrangement may comprise, for each portion of the surface, a plurality of small individual diaphragms or a single diaphragm covering the whole surface portion. The natural oscillation of the diaphragm is selected so as to obtain, in connection with the frequency response of the electroacoustic transducer and the large-surface acoustic frictional resistance, the frequency characteristic of FIG. 1, for example, for the frontal incidence of the sound.

Due to the presence of a plurality of parameters which are preferentially effective in the different frequency ranges, it is possible to obtain the optimum frequency characteristic of the headphone.

Figure 15:
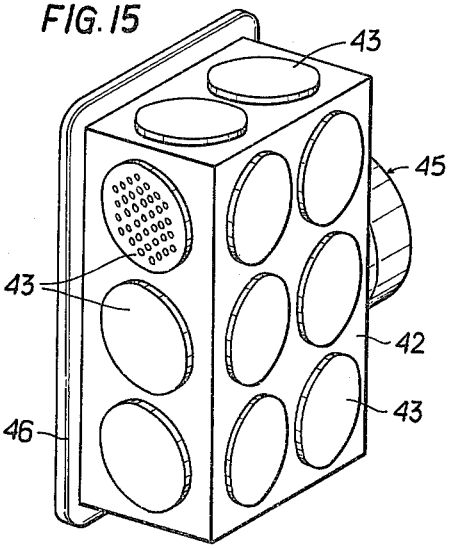
FIGS. 15 and 16 are perspective views of an embodiment of an earpiece with 15 passive diaphragms and one dynamic transducer in a side wall.
Figure 16:
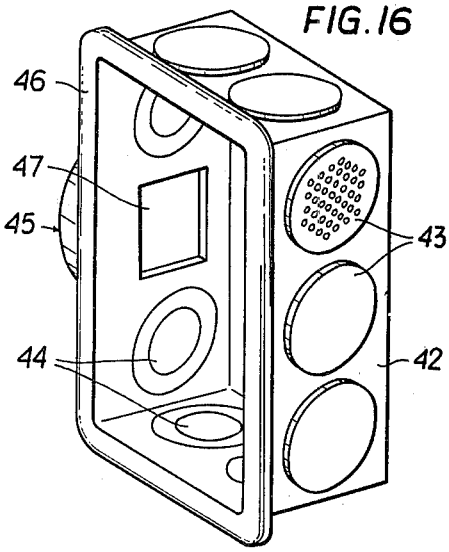

FIG. 15 is a perspective view from above of an earpiece comprising fifteen (15) passive diaphragms. In a case 42, fifteen (15) acoustic frictional resistances 43 are inserted and, in front of each of them, a respective passive diaphragm 44 is provided. These diaphragms 44 are visible in FIG. 16. For reasons of clarity, the protective grill provided in front of the diaphragms is omitted in the showing. An electroacoustic transducer 45 is inserted in the side wall of case 42 and transmits the sound through an aperture 47 into the coupling space. The ear pad is very flat, in order to avoid reflections, in accordance with the invention.

While specific embodiments of the invention have been shown and described in detail to illustrate the application of the principles of the invention, it will be understood that the invention may be embodied otherwise without departing from such principles.

What is claimed is:

1. A headphone engageable on a person's head around the ear, comprising a cup-shaped case having an encircling rim around its periphery, a flat soft sealing strip engaged around said rim and engageable with the wearer's head around the ear having a maximum thickness of approximately three mm, said case forming a coupling space enclosing the user's ear, at least one electroacoustic transducer having a diaphragm included in cup-shaped case, acoustic frictional resistance means coextensive with all of the surfaces of said cup-shaped case, and compensating means for reduction of responses at low frequencies operatively associated with said headphone.

2. A headphone of circumaural design, as claimed in claim 1, in which said cup-shaped case is designed as an acoustic frictional resistance constituting said acoustic frictional resistance means.

3. A headphone of circumaural design, as claimed in claim 1, in which said cup-shaped case forms a supporting structure for an acoustic frictional resistance constituting said acoustic frictional resistance means.

4. A headphone of circumaural design, as claimed in claim 1, designed as a headphone of a stereo headset in which, in use, the electroacoustic transducer of each headphone is positioned laterally, at the front side and near said rim, of said cup-shaped case.

5. A headphone of circumaural design, as claimed in claim 1, designed as a headphone of a quadraphonic headset in which, in use, one of the electroacoustic transducers of each headphone is positioned laterally at the front side, and the other electroacoustic transducer of each headphone is positioned laterally at the rear side, both electroacoustic transducers of each headphone being near the rim of the respective cup-shaped case.

6. A headphone according to claim 1 wherein said compensating means comprises an acoustic device.

7. A headphone according to claim 1 wherein said compensating means comprises a blind diaphragm arranged closely adjacent said cup-shaped acoustic frictional resistance means.

8. A headphone according to claim 1 wherein said compensating means comprises an air mass which is coupled to the diaphragm of said electroacoustic transducer.

* * * * *